US009505419B2

(12) United States Patent
Ciloglu

(10) Patent No.: US 9,505,419 B2
(45) Date of Patent: Nov. 29, 2016

(54) SIGNAL BOND PLATE

(71) Applicant: Korhan Ciloglu, Pittsburgh, PA (US)

(72) Inventor: Korhan Ciloglu, Pittsburgh, PA (US)

(73) Assignee: L.B. Foster Company, Pittsburgh, PA (US)

( * ) Notice: Subject to any disclaimer, the term of this patent is extended or adjusted under 35 U.S.C. 154(b) by 90 days.

(21) Appl. No.: 13/728,917

(22) Filed: Dec. 27, 2012

(65) Prior Publication Data

US 2013/0161406 A1 Jun. 27, 2013

Related U.S. Application Data

(60) Provisional application No. 61/580,586, filed on Dec. 27, 2011.

(51) Int. Cl.
*B60M 5/00* (2006.01)
*B61L 1/18* (2006.01)

(52) U.S. Cl.
CPC . *B61L 1/181* (2013.01); *B61L 1/18* (2013.01)

(58) Field of Classification Search
CPC ..... B60M 5/00; B60M 5/02; E01B 26/00; E01B 2201/00; E01B 2201/10
USPC ..... 238/14.05, 14.12, 14.14, 151, 310, 311, 238/336, 338
See application file for complete search history.

(56) References Cited

U.S. PATENT DOCUMENTS 3,830,427 A * 8/1974 Polidori ..... H01R 4/363 238/14.14

* cited by examiner

*Primary Examiner* — R. J. McCarry, Jr.
(74) *Attorney, Agent, or Firm* — Clark Hill, PLC; Paul D. Bangor, Jr.

(57) ABSTRACT

A signal bond plate system for electrically bonding onto a railroad rail comprising: first and second conductive plates, first and second wires; and first and second conductive washers; a boltlike attachment means attaching, in order, the first conductive plate, the first conductive washer, a web of the rail, the second conductive washer, and the second conductive plate; the conductive plates each having an inside surface proximal to the web of the rail and an outside surface distal to the web of the rail; each wire having a wire first end and a wire second end; each conductive plate having a conductive plate first end and a conductive plate second end; the first wire first end is attached to the first conductive plate near the first conductive plate first end at a first attachment point; the first wire second end attached to the rail; the second wire first end attached to the second conductive plate first end at a second attachment point; the second end of the second wire attached to the rail; the first cover plate attached to the outside surface of the first conductive plate; and the second cover plate attached to an outside surface of the second conductive plate.

6 Claims, 5 Drawing Sheets

SIGNAL BOND PLATE

RELATED APPLICATION

This application claims priority benefit under 35 U.S.C. §119(e) of U.S. Provisional Application No. 61/580,586, filed Dec. 27, 2011, the contents of which are herein incorporated by reference.

TECHNICAL FIELD

The field of the present disclosure is railroad track system, and more particularly, making electrical connections to rails especially at insulated joint locations.

BACKGROUND

Track circuits in railroad tracks are used to control signals for trains and detect broken rails. Railroad rails are utilized in these circuits as electrically conductive elements and they transmit low-voltage electrical current until terminated by an electrical insulator. Insulated rail joints are used to block transmission of this electrical current in the rail without disturbing the structural continuity or integrity of the rail.

Typical track circuits work with the principle of train wheels and axles making an electrical connection between two parallel rails that are electrically separated otherwise and shunting the tracks, thence de-energizing the signal relay system, thence dictating the color of the signal light (red, green etc).

Insulated rail joints are used at the ends of track circuits to electrically block out a section of a railroad track. The main design principle of insulated rail joints is to maintain railroad tracks structural integrity while creating an electrically insulating gap in a railroad rail. This is commonly accomplished by gluing and bolting two insulated rail joint bars to a rail with insulating bushings around the bolts and using a insulating piece about 0.25 inch in thickness matching the shape of the cross section of rails between the two rails. There are various insulated joint designs and some of them do not incorporate an adhesive.

Low-voltage electrical power source and signal relay system need to be physically and electrically connected to the rail where insulated rail joints are located. These connections (a.k.a. rail bonds) are carried out by either drilling the rail and inserting the electrical connector through this hole or welding electrically conductive tabs on the rail. Furthermore, usually more than one connection is needed during the life-cycle of an insulated rail joint in track, hence field maintenance crews weld tabs or drill rails in the operational environment where high quality control measures may not be always achievable. Attachment of rail bonds to rails should minimize damage to the rail, as every damage to the rail is a safety risk. Additional considerations for rail bond attachment are low resistance, long fatigue life, accommodation of normal rail movements, certainty to fail in abnormal rail movements, facility of installation, and facility of inspection and maintenance. Various clamping and force fit connecting devices have been used in holes bored in the rail sections. These sometimes result in an unsatisfactory physical rail connection and breakdowns are caused by rail vibration, the adverse effects of inclement weather, etc. When welding or brazing of numerous bond wires to rails is used heating of the rail inherent in the welding process may cause flaws in the rail, making the rail more likely to fail or break. Further limitations and disadvantages of conventional and traditional approaches will become apparent to one of skill in the art through comparison of such systems with the present disclosure as set forth in the remainder of the present application with reference to the drawings.

SUMMARY

An illustrative embodiment of the present disclosure is directed to a signal bond plate system that includes a rail, a first and second conductive plates, a first and second wires; a first and second conductive washers, a first and second insulating washers. The system also has boltlike attachment means for attaching in order, the first conductive plate, the first conductive washer, a web of the rail, the second conductive washer and the second conductive plate. The conductive plates have an inside surface closest to the rail and an outside surface away from the rail. A first end of the first wire is attached near a first end of the first conductive plate by welding. A second end of the first wire is attached to the rail by welding. A first end of the second wire is attached to the second conductive plate by welding. A second end of the second wire is attached to the rail by welding. All welds are carried out in a factory environment where the quality of the weld is controlled. It is a common proactive practice to employ separation welds on each side of the rail web in the direction of the rail to avoid welding on both sides of the rail at the same cross section. This is done to reduce the risk of creating a brittle heat affected zone, hence there is about a 2 inch difference between the length of the first and the second wires (as 2 inch stagger). The first cover plate attached to the outside surface of the first conductive plate proximal to the first wire attachments and the second cover plate attached to an outside surface of the second conductive plate proximal to the first wire attachments. In one embodiment of the present disclosure, the conductive washers have one surface mating to the contiguous concave surfaces of the rail including the rail head, the rail web, and rail foot; and wherein the conductive washers have another surface mating to the inside surface of the adjacent conductive plate. Further, some preferred embodiments have an insulating washer attached to the conductive plate. The insulating washer having one surface mating to the contiguous concave surfaces of the rail head, rail web, and rail foot; and another surface mating to the inside surface of the conductive plate.

Another illustrative embodiment of the present disclosure is directed to a signal bond plate that includes a conductive plate, a wire, a cover plate, and boltlike attachment means for attaching the conductive plate and conductive washer. The first end of the wire is attached to the conductive plate and the cover plate is attached proximal to the wire attachment. In one embodiment of the present disclosure, the conductive washer has one surface mating to the contiguous concave surfaces of a rail head, rail web, and rail foot, and the conductive washer has another surface mating to an inside surface of the conductive plate. Further, some preferred embodiments have an insulating washer attached to the conductive plate distal to the wire attachment. The insulating washer having one surface mating to the contiguous concave surfaces of the rail head, rail web, and rail foot; and another surface mating to the inside surface of the conductive plate.

Preferably, additional conducting wires may be attached to each of the plates wherein the additional conducting wires may be used to connect to various electrical signals to the rail. The arrangement minimizes potential for rail failures due to multiple drilling or welding of the rail.

These and other advantages of the present disclosure will be appreciated by reference to the detailed description of the preferred embodiment(s) that follow.

BRIEF DESCRIPTION OF THE DRAWINGS

For the present disclosure to be easily understood and readily practiced, the present disclosure will now be described for purposes of illustration and not limitation in connection with the following figures, wherein.

DETAILED DESCRIPTION

In the following detailed description, reference is made to the accompanying examples and figures that form a part hereof, and in which is shown, by way of illustration, specific embodiments in which the illustrated subject matter may be practiced. These embodiments are described in sufficient detail to enable those skilled in the art to practice them, and it is to be understood that other embodiments may be utilized and that structural or logical changes may be made without departing from the scope of the subject matter. The following description is, therefore, not to be taken in a limited sense, and the scope of the subject matter is defined by the appended claims and their equivalents.

Figure 1:
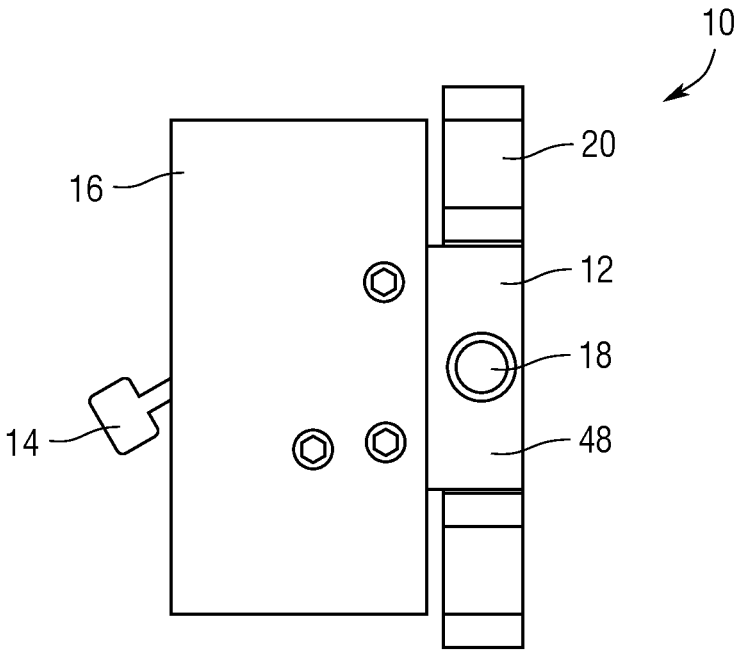
FIG. 1 is a side view drawing showing a preferred signal bond plate according to an illustrative embodiment of the present disclosure.
Figure 2:
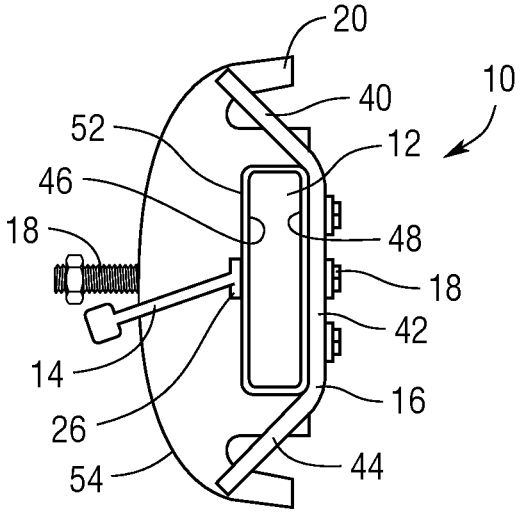
FIG. 2 is a front end view of a preferred signal bond plate according to an illustrative embodiment of the present disclosure.

In general, the present disclosure preferably comprises a bond apparatus utilizing a set of electrically conductive and insulating elements and/or features for attachment of signal bondwires. FIGS. 1-2 show a signal bond plate 10 according to an illustrative embodiment of the present disclosure. The signal bond plate 10 of FIG. 1 includes a conductive plate 12, a wire 14 attached to the conductive plate 12, a cover plate 16, a boltlike attachment means 18 for attaching the conductive plate 12 and a conductive washer 20. The attachment of the cover plate 16 to the conductive plate 12 covers the point of attachment of the wire 14 to the conductive plate 12 as seen in FIG. 2.

In an illustrative embodiment of the present disclosure, the boltlike attachment means may be temporary. The boltlike attachment means 18 may be comprised of a bolt passing through conductive plate 12 and conductive washer 20. In preferred embodiments of the present disclosure, the boltlike attachment means is permanent. In an embodiment of a permanent attachment, boltlike attachment means 18 is comprised of a threaded bolt. In a more preferred embodiment, boltlike attachment means 18 is a tension bolt (e.g. huck bolts made by Alcoa Fastening Systems or similar).

In illustrative embodiments, the conductive washer 20 has a first surface 52 that mates an inside surface 46 of the conductive plate 12 (see FIG. 2). In preferred embodiments, the conductive washer 20 has second surface 54 that mates contiguous concave surfaces of a railway rail.

In some preferred embodiments, the wire 14 comprises copper wire. In preferred embodiments, the wire 14 is stranded copper wire. A first end 26 of the wire 14 is attached to conductive plate 12. In some preferred embodiments, the first end 26 is attached to inside surface 46. In preferred embodiments, first end 26 is attached to conductive plate 12 by fastener means. In more preferred embodiments, first end 26 is attached by welding. In even more preferred embodiments, first end 26 is attached to conductive plate 12 by brazing. In some preferred embodiments first end 26 is a terminal for connection of a fastener. In preferred embodiments, first end 26 has a generally rectangular tab shape.

The conductive plate 12 can be of any number of different shapes and sizes in accordance with the present disclosure. Preferably, conductive plate 12 has a generally rectangular bar shape.

In preferred embodiments, cover plate 16 is attached to an outside surface 48 of the conductive plate 12. In an illustrative embodiment of the present disclosure, the cover plate 16 is attached on outside surface 48 opposite the attachment of first end 26 on inside surface 46. Cover plate 16 can be of any number of different shapes and sizes in accordance with the present disclosure. In a preferred embodiment, cover plate 16 is an angled plate of three consecutive planes. In the preferred embodiment, a first plane 40 meets the second plane 42 at an obtuse angle, see FIG. 2, and a third plane 44 also meets the second plane 42 at an obtuse angle. The cover plate 16 may be made of any durable material such as a metal, a plastic, composite or the like.

Figure 3:
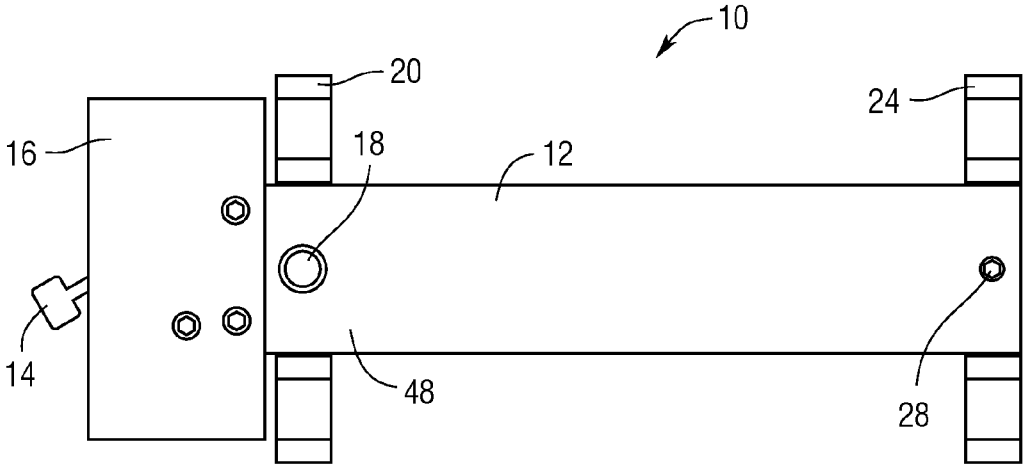
FIG. 3 is a side view drawing showing a preferred signal bond plate according to an illustrative embodiment of the present disclosure.
Figure 4:
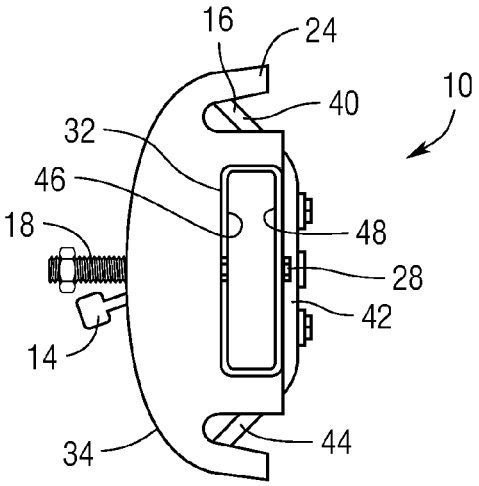
FIG. 4 is a rear end view of a preferred signal bond plate according to an illustrative embodiment of the present disclosure.

As shown in illustrative embodiments shown in FIG. 3, the conductive plate 12 may be attached to an insulating washer 24. In preferred embodiments the conductive plate 12 is attached to insulating washer 24 by a fastener 28 through the conductive plate 12 and into the insulating washer 24, but fastener 28 does not fully penetrate insulating washer 24. As shown in FIG. 4, some preferred embodiments having an insulating washer 24, the insulating washer 24 has an insulator inner surface 32 that mates the inside surface 46 of the conductive plate 12. In preferred embodiments, the insulating washer 24 has an insulator outer surface 34 that mates contiguous concave surfaces of a railway rail. Although not shown in the illustrations, the insulated washer may be snap-fitted on the conductive plate without using a mechanical fastening device.

In use, the signal bond plate 10 may be attached to a railway rail by boltlike attachment means 18. Electrical contact between conductive plate 12 and the railway rail is achieved through physical contact of the conductive plate 12 to the conductive washer 20, and by physical contact of conductive washer 20 and railway rail. A no-oxide paste (e.g. No-Oxide paste made by SanChem Inc.) is preferred among all mating surfaces that are electrically conductive to eliminate the risk of reduction in the level of electrical conductivity as a result of galvanic corrosion. In addition, electrical contact between conductive plate 12 and the railway rail is achieved through wire 14 attached at first end 26 to conductive plate 12, and a second end 50 of wire 14 may be attached to the railway rail. Mated surfaces of the conductive washer 20 provide stability of signal bond plate 10. Cover plate 16 protects the attachments of copper wire 14 from physical abuse during installation or use. When employed, insulating washer 24 may have surfaces that mate conducting plate 12 and a railway rail. So mated, insulating washer 24 hinders movement of conductive plate 12. Conductive plate 12 provides surface for attachment of additional copper wires 14. Additional copper wires 14 may be for attachment to the railway rail or for connection to an auxiliary apparatus, for example a battery and a signal. In a preferred embodiment, the conductive plate 12 may accommodate up to eight copper wires 14. In other preferred embodiments, the conductive plate 12 may accommodate less than eight copper wires 14, while in still other preferred embodiments, the conductive plate 12 may accommodate more than eight copper wires 14. The design of washers restrains the displacement and rotation of the conductive plate 12.

Figure 5:
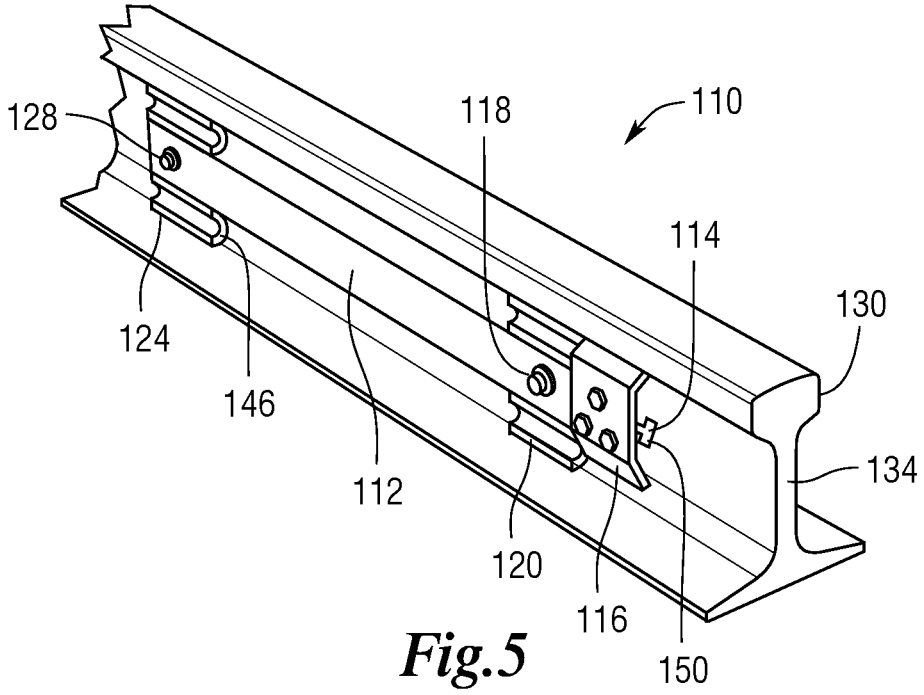
FIG. 5 is a left perspective drawing showing a preferred signal bond plate system according to an illustrative embodiment of the present disclosure.
Figure 6:
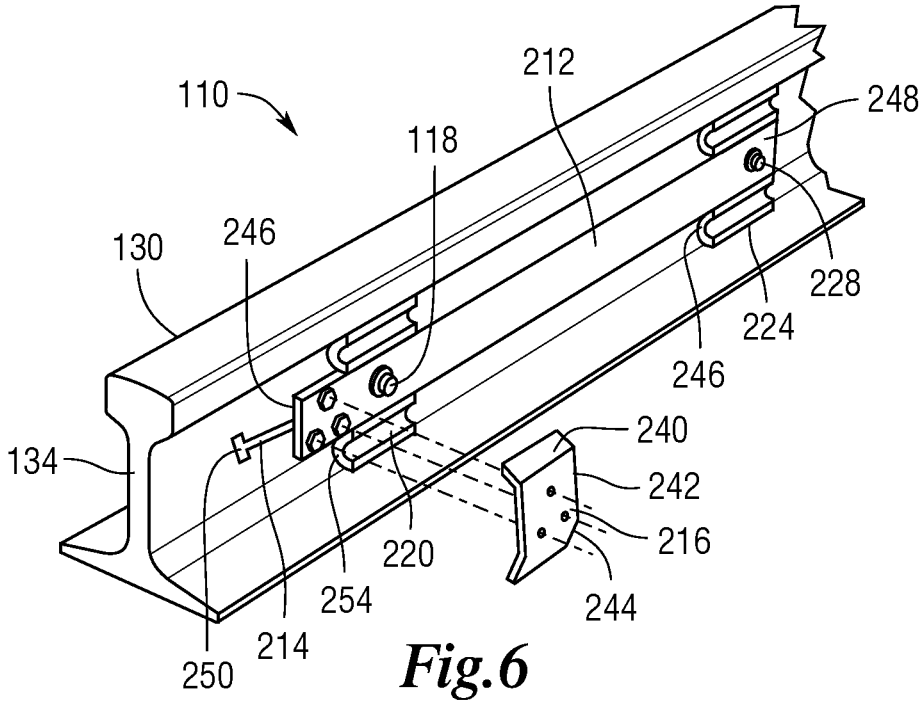
FIG. 6 is a right perspective drawing showing a preferred signal bond plate system plate according to an illustrative embodiment of the present disclosure.
Figure 7:
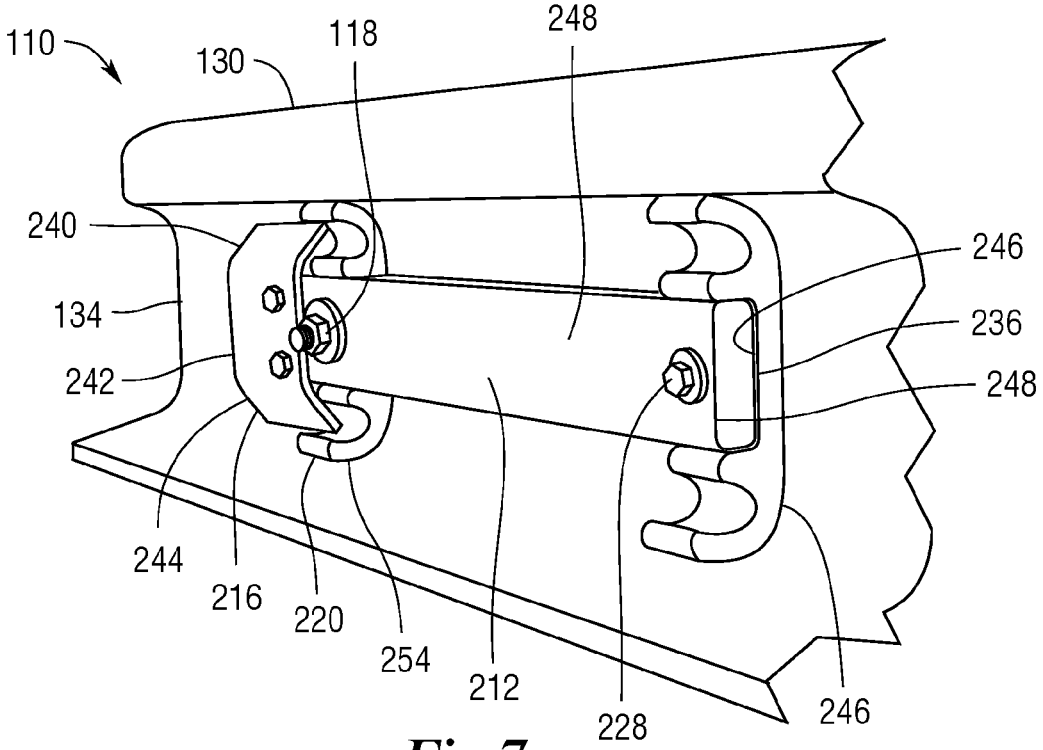
FIG. 7 is a perspective drawing showing a preferred signal bond plate system according to an illustrative embodiment of the present disclosure.

FIGS. 5-9 show a signal bond plate system 110 according to another illustrative embodiment of the present disclosure. Signal bond plate system 110 includes a first conductive plate 112 and a second conductive plate 212, a first wire 114 attached to the conductive plate 112, a second wire 214 attached to the second conductive plate 212, a first cover plate 116 attached to the first conductive plate 112, a second cover plate 216 is attached to second conductive plate 212, a boltlike attachment means 118 for attaching in order conductive plate 112, a first washer 120, a railway rail 130 at a rail web 134, a second washer 220, and second conductive plate 212. FIG. 5 illustrates a perspective view of a first side of the signal bond plate system 110, FIG. 6 illustrates a perspective view of a second side of the signal bond plate system 110 with the cover plate 216 detached, and FIG. 7 is yet another perspective of the second side of the signal bond plate system 110 with cover plate 216 attached. The conductive plates 112 and 212 can be of any number of different shapes and sizes in accordance with the present disclosure. Preferably, conductive plates 112 and 212 have generally rectangular bar shapes.

Figure 8:
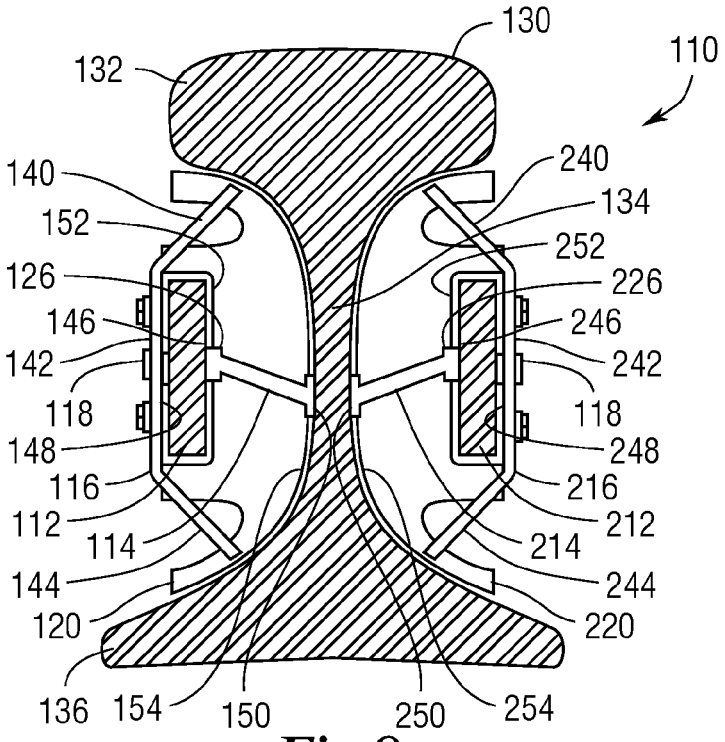
FIG. 8 is a front end view of a preferred signal bond plate system according to an illustrative embodiment of the present disclosure.
Figure 9:
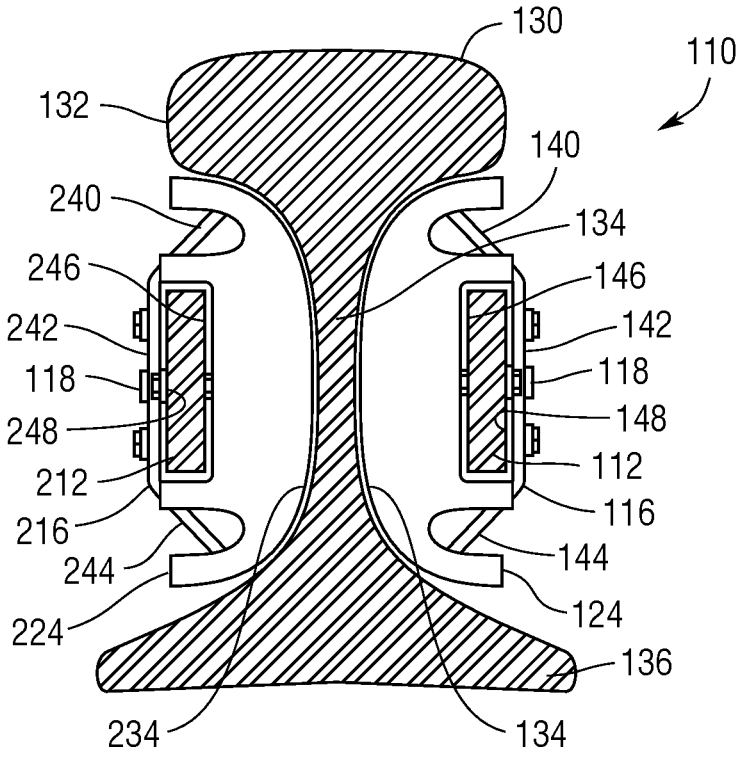
FIG. 9 is a rear end view of a preferred signal bond plate system according to an illustrative embodiment of the present disclosure.

In some preferred embodiments, first wire 114 and second wire 214 are comprised of copper wire. In preferred embodiments, first wire 114 and second wire 214 are comprised of stranded copper wire. As illustrated in FIG. 8, in certain embodiments, a first wire first end 126 is attached to a first conductive plate inside surface 146, and a second wire second end 226 is attached to second conductive plate inside surface 246. In preferred embodiments, the stranded copper wires are different in length (about 2 inch or similar) to avoid welding or brazing at the same rail cross section on each side of the rail. In some preferred embodiments, first cover plate 116 is attached to a first conductive plate outside surface 148 opposite the point of attachment of first wire first end 126 to first conductive plate 112, and second cover plate 216 is attached to a second conductive plate outside surface 248 opposite the point of attachment of second wire first end 226 to second conductive plate 212.

In an illustrative embodiment of the present disclosure, the boltlike attachment means may be temporary. The boltlike attachment means 118 may be comprised of a bolt that passing through the conductive plates 112 and 212 and the conductive washers 120 and 220 and the rail web 134. In preferred embodiments of the present disclosure, the boltlike attachment means is permanent. In an embodiment of a permanent attachment, the boltlike attachment means 118 is comprised of a threaded bolt. In a more preferred embodiment, the boltlike attachment means 118 is a tension bolt.

In illustrative embodiments, first conductive washer 120 has a first conductive washer first surface 152 that mates first conductive plate inside surface 146. In preferred embodiments, the first conductive washer 120 has first conductive washer second surface 154 that mates contiguous concave surfaces of the rail 130, the concave surface comprising a rail head 132, rail web 134 and a rail foot 136, and second conductive washer 220 has a second conductive washer first surface 252 that mates a second conductive plate inside surface 246 and second conductive washer 220 has a second conductive washer second surface 254 that mates contiguous concave surfaces of railway rail 130, the concave surface comprising rail head 132, rail web 134 and rail foot 136.

In some preferred embodiments, the first ends 126 and 226 are attached by fastener means. In more preferred embodiments, the first ends 126 and 226 are attached by welding. In even more preferred embodiments, the first ends 126 and 226 are attached by brazing. In some preferred embodiments the first ends 126 and 226 are a terminal for connection of a fastener. In preferred embodiments, the first ends 126 and 226 have a tab shape.

The cover plates 116 and 216 can be of any number of different shapes and sizes in accordance with the present disclosure. In preferred embodiments, cover plates 116 and 216 are angled plates each having three consecutive planes. In a preferred embodiment of first cover plate 116, a first cover first plane 140 meets the first cover second plane 142 at an obtuse angle, and a first cover third plane 144 also meets the first cover second plane 142 at an obtuse angle. Similarly, a preferred embodiment of second cover plate 216, a second cover first plane 240 meets the second cover second plane 242 at an obtuse angle, and a second cover third plane 244 also meets second cover second plane 242 at an obtuse angle. The cover plates 116 and 216 may be made of any durable material such as a metal, a plastic, composite or the like.

First conductive plate 112 may be attached to a first insulating washer 124. Similarly, second conductive plate 212 may be attached to a second insulating washer 224. In preferred embodiments first conductive plate 112 is attached to a first insulating washer 124 by a first fastener 128 through first conductive plate 112 and into first insulating washer 124, but does not fully penetrate first insulating washer 124, and second conductive plate 212 is attached to a second insulating washer 224 by a second fastener 228 through second conductive plate 212 and into second insulating washer 224, but does not fully penetrate second insulating washer 224. In some preferred embodiments having first insulating washer 124, first insulating washer 124 has a first inner surface 136 that mates a first conductive plate inside surface 146, and second insulating washer 224 has a second inner surface 236 that mates second conductive plate inside surface 246.

First wire 114 has a first wire second end 150 attached to the railway rail 130. In preferred embodiments, first wire second end 150 is attached to rail web 130 by fastener means. In more preferred embodiments, the first wire second end 150 is attached by welding. In even more preferred embodiments, the attachment is by brazing. Similarly, second wire 214 has a second wire second end 250 attached to the railway rail 130. In preferred embodiments, second wire second end 250 is attached to rail web 134 by fastener means. In more preferred embodiments, the second wire second end 250 is attached by welding. In even more preferred embodiments, the attachment is by brazing. In various embodiments the ends 126, 226, 150 and 250 may be a terminal for connection of a fastener, blunt wires, a tab shape, or a combination of fastener, blunt wires, and tab shapes.

In use, the signal bond plates system 110 has conductive plates 112 and 212 on either side of a railway rail web 134. Electrical contact between the conductive plates 112 and 212 with the railway rail 130 is achieved by physical contact of the conductive plates 112 and 212 with the respective washers 120 and 220 and rail web 130. In addition, electrical contact between the conductive plates 112 and 212 and rail web 130 is achieved through the respective attached wires 114 and 214. Mated surfaces of the conductive washers 120 and 220 provide stability of the signal bond plate system 110. First cover plate 116 protects the attachment of first wire 114, and second cover plate 216 protects attachment of second wire 214 from physical abuse during placement of rail 130 or during use. When employed, insulating washers 124 and 224 may have surfaces that mate the adjacent conductive plate 112 or 214 and the rail web 134. So mate, insulating washers 124 and 224 hinder movement of the signal bond plate system 110. The conductive plates 112 and 212 provide surface for attachment of at least one wire 114 and 214. Additional wires 114 and 214 may be attached for connection to the railway rail 130 or for connection to an auxiliary apparatus, for example a battery and a signal. In a preferred embodiment, the conductive plates 112 or 214 may accommodate up to eight wires 114 and 214 each. In other preferred embodiments, the conductive plates 112 or 214 may accommodate less than eight wires 114 and 214, while in other preferred embodiments, the conductive plates 112 or 214 may accommodate more than eight wires 114 and 214.

The present disclosure's preferred conductive plate means of bonding an electrical connection to a rail provides many advantages over prior art means such as welding and mechanical bonding means. The installation of the signal bond plate or signal bond plate system preferably requires only one hole be drilled into the rail web and one weld applied on the rail. Each of the conductive plates is preferably connected to a rail web by a conductive wire, such as a bondwire. By minimizing the number of holes drilled and then welding or brazing directly onto the rail, the structure of the rail is maintained. Preferably, when conductive plates are placed on opposite sides of a rail, conductive wires connecting the rail web to the conductive plates are attached at a two inch stagger. The conductive wire attachments to the rail web are preferably placed very close to an insulated bar at an insulated joint. The covers protect the conductive wires from physical abuse during laying of the rails or during use. Further, additional conductive wires or bondwires preferably may be attached directly to conductive plates instead of the rail or rail web, further extending the life of the rails. The signal bond plates preferably may be installed on site or may be pre-attached. Pre-attachment allows welding or brazing to a dry, clean rail improving attachment. The signal bond plates and system of the present disclosure minimize stress to the rail, avoiding the damage caused by the extremities of high temperature inherent with multiple weldings to the rail and minimize the damage caused by drilling holes in the rail.

In the foregoing Detailed Description, various features are grouped together in a single embodiment to streamline the disclosure. This method of disclosure is not to be interpreted as reflecting an intention that the claimed embodiments of the present disclosure require more features than are expressly recited in each claim. Rather, as the following claims reflect, claimed subject matter may lie in less than all features of a single disclosed embodiment. Further, although elements of the described aspects and/or embodiments may be described or claimed in the singular, the plural is contemplated unless limitation to the singular is explicitly stated. The following claims are hereby incorporated into the Detailed Description, with each claim standing on its own as a separate embodiment.

What is claimed is:

1. An apparatus for making electrical connection to a railroad rail comprising:

a first conductive plate and a first conductive washer;

an attachment device attaching, in order, the first conductive plate, the first conductive washer and a first side of a web of the rail;

wherein the first conductive washer is in electrical contact with the first side of the web of the rail, the first conductive plate is in electrical contact with the first conductive washer and the first conductive plate is in electrical contact with the rail via the first conductive washer; and wherein the first conductive washer has a conductive washer inner surface substantially complementary to a side of the rail as defined by a head of the rail, the first side of the web of the rail, and a foot of the rail; and wherein the first conductive washer has a conductive washer outer surface substantially complementary to an inside surface of the first conductive plate.

2. An apparatus for making electrical connection to a railroad rail comprising:

a first conductive plate and a first conductive washer;

an attachment device attaching, in order, the first conductive plate, the first conductive washer and a first side of a web of the rail;

wherein the first conductive washer is in electrical contact with the first side of the web of the rail, the first conductive plate is in electrical contact with the first conductive washer and the first conductive plate is in electrical contact with the rail via the first conductive washer; and further comprising a first insulating washer attached by a second attachment device to the first conductive plate at a location spaced apart from the first conductive washer.

3. The apparatus of claim 2, further comprising a second conductive plate and a second conductive washer; wherein the attachment device attaches, in order, the first conductive plate, the first conductive washer, the web, the second conductive washer, and the second conductive plate; wherein the second conductive washer is in electrical contact with a second side of the web, the second conductive plate is in electrical contact with the second conductive washer and the second conductive plate is in electrical contact with the rail via the second conductive washer; and further comprising a second insulating washer attached by a third attachment device to the second conductive plate at a location spaced apart from the second conductive washer.

4. The apparatus of claim 3, wherein the second insulating washer has an insulating washer inner surface substantially complementary to a second side of the rail as defined by a head of the rail, the second side of the web, and a foot of the rail and an insulating washer outer surface substantially complementary to an inside surface of the second conductive plate.

5. The apparatus of claim 2, wherein the first insulating washer has an insulating washer inner surface substantially complementary to a first side of the rail as defined by a head of the rail, the first side of the web, and a foot of the rail and an insulating washer outer surface substantially complementary to an inside surface of the first conductive plate.

6. An apparatus for making electrical connection to a railroad rail comprising:

a first conductive plate and a first conductive washer;

an attachment device attaching, in order, the first conductive plate, the first conductive washer and a first side of a web of the rail;

wherein the first conductive washer is in electrical contact with the first side of the web of the rail, the first conductive plate is in electrical contact with the first conductive washer and the first conductive plate is in electrical contact with the rail via the first conductive washer; and further comprising a second conductive plate and a second conductive washer; wherein the attachment device attaches, in order, the first conductive plate, the first conductive washer, the web, the second conductive washer, and the second conductive plate; and wherein the second conductive washer is in electrical contact with a second side of the web, the second conductive plate is in electrical contact with the second conductive washer and the second conductive plate is in electrical contact with the rail via the second conductive washer.

* * * * *